US007836839B2

(12) United States Patent
Park

(10) Patent No.: US 7,836,839 B2
(45) Date of Patent: Nov. 23, 2010

(54) SEWN GLOVE AND METHOD OF MANUFACTURING THE SAME

(76) Inventor: Chan-moon Park, 105-501 Samsung Apt., 437 Changjeon-dong, Mapo-gu, Seoul (KR) 121-778

( * ) Notice: Subject to any disclaimer, the term of this patent is extended or adjusted under 35 U.S.C. 154(b) by 573 days.

(21) Appl. No.: 11/855,209

(22) Filed: Sep. 14, 2007

(65) Prior Publication Data

US 2008/0196647 A1 Aug. 21, 2008

(30) Foreign Application Priority Data

Feb. 20, 2007 (KR) ..... 10-2007-0016911

(51) Int. Cl.
*D05B 15/00* (2006.01)
*A41D 19/02* (2006.01)

(52) U.S. Cl. ..... 112/475.09; 2/161.1

(58) Field of Classification Search ..... 2/16–21, 2/158, 159–161.8, 163–170; 112/475.01, 112/475.08, 475.09, 475.17
See application file for complete search history.

(56) References Cited

U.S. PATENT DOCUMENTS 1,765,282 A * 6/1930 McKinley ..... 2/169
4,164,043 A * 8/1979 Fujita ..... 2/161.1
4,590,627 A * 5/1986 Connelly ..... 2/163
6,427,246 B1 * 8/2002 Doi et al. ..... 2/161.1
7,062,791 B2 * 6/2006 Gold ..... 2/161.6
2003/0167553 A1 * 9/2003 Caswell et al. ..... 2/161.1
2005/0010990 A1 * 1/2005 Jang ..... 2/161.6
2007/0022513 A1 * 2/2007 Avis et al. ..... 2/169

* cited by examiner

*Primary Examiner*—Ismael Izaguirre
(74) *Attorney, Agent, or Firm*—Cantor Colburn LLP

(57) ABSTRACT

A method of manufacturing a sewn glove having no seam at a crotch portion thereof by sewing a first sheath member cut for a palm portion of the sewn glove with a second sheath member cut for a back portion of the sewn glove includes: cutting a sheath member to have a crotch pre-form section; modifying the crotch pre-form section of the sheath member into a three-dimensional crotch form section having a crotch form face and a cut line; and sewing the first sheath member, which is cut from the sheath member having the three-dimensional crotch form section to include the three-dimensional crotch form section, with the second sheath member cut for the back portion of the sewn glove.

4 Claims, 4 Drawing Sheets

[Fig. 1]
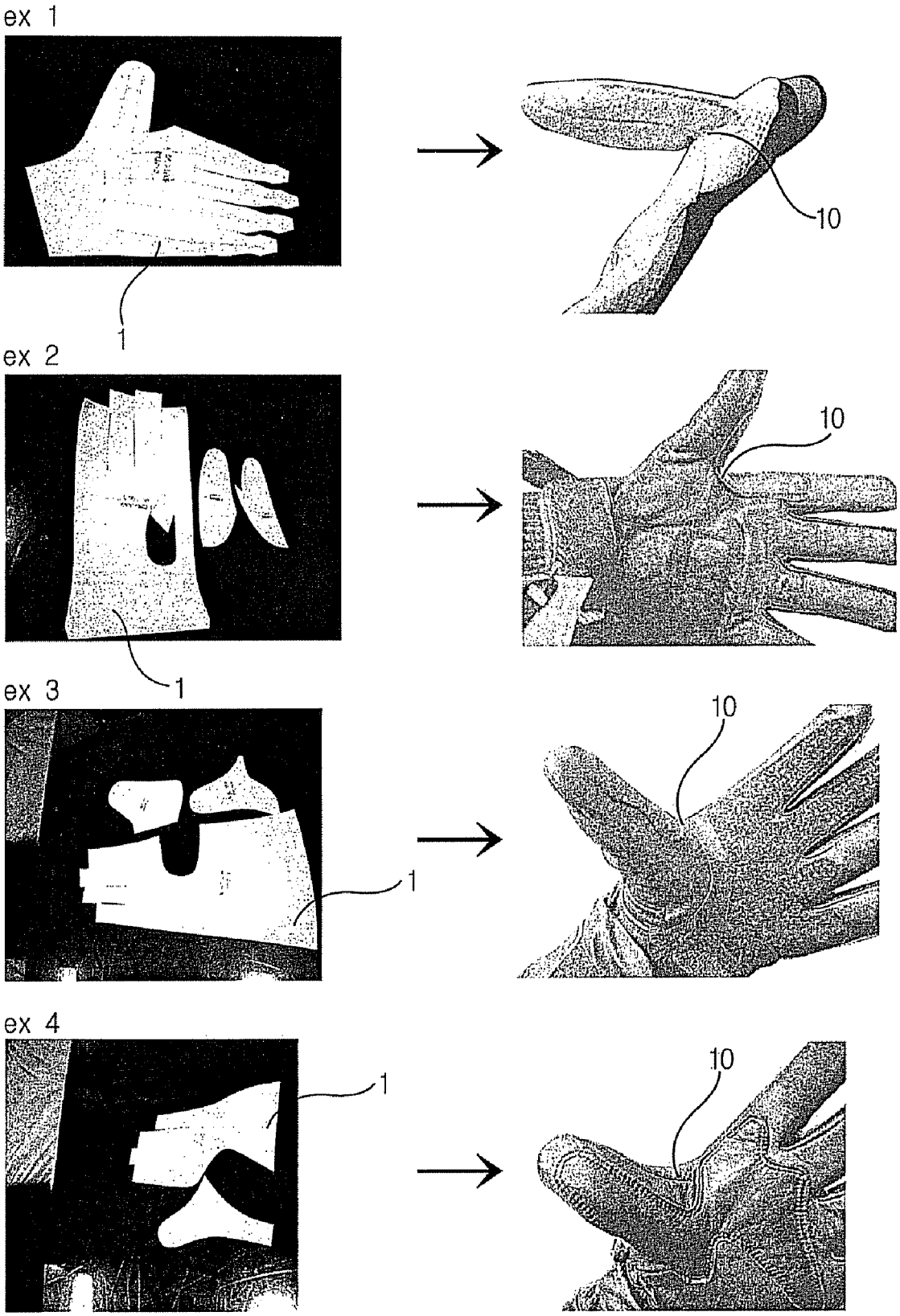

[Fig. 2]
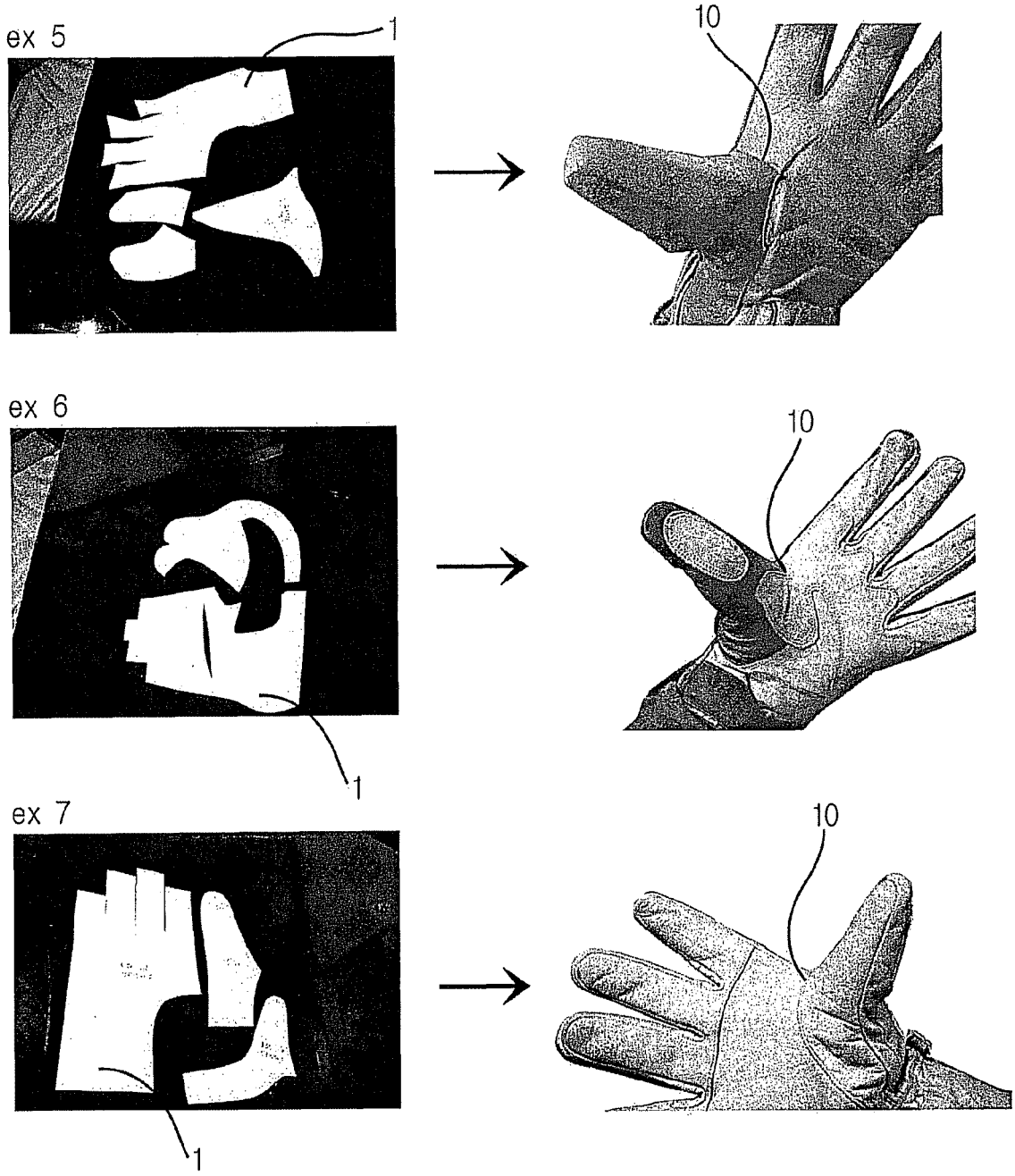

[Fig. 3]
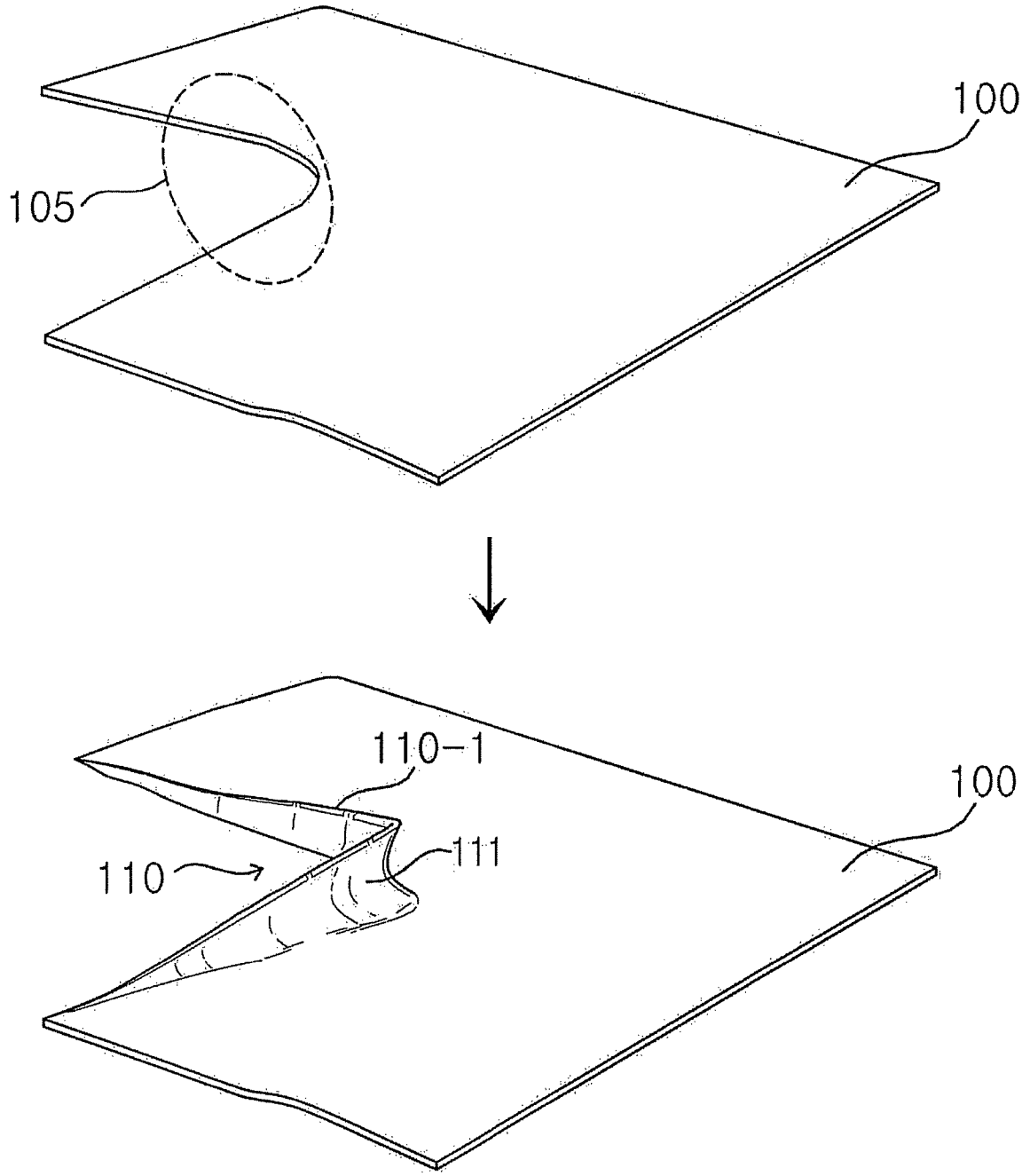

[Fig. 4]
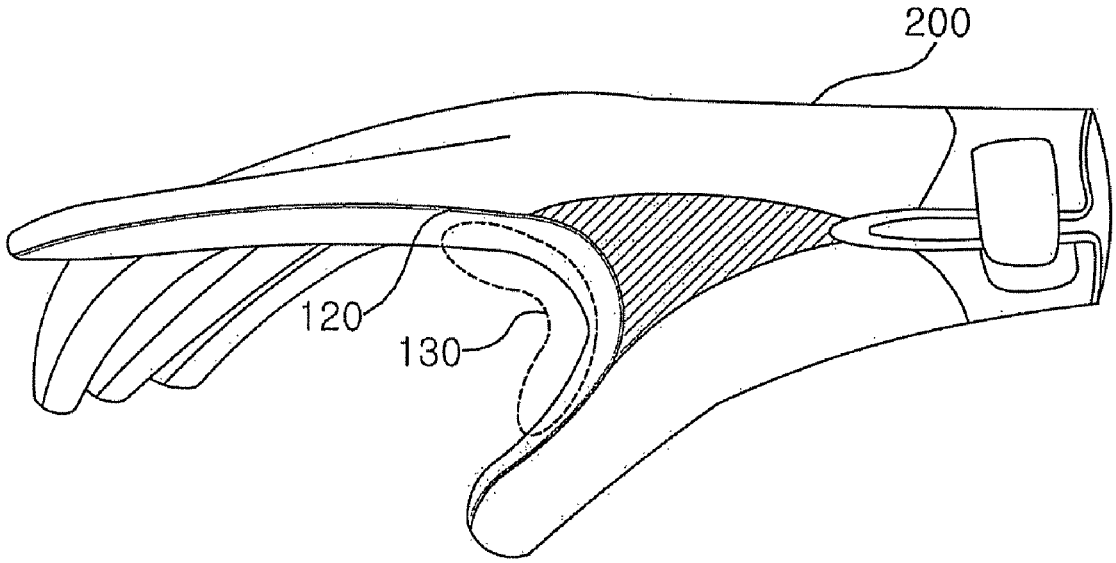
[Fig. 5]
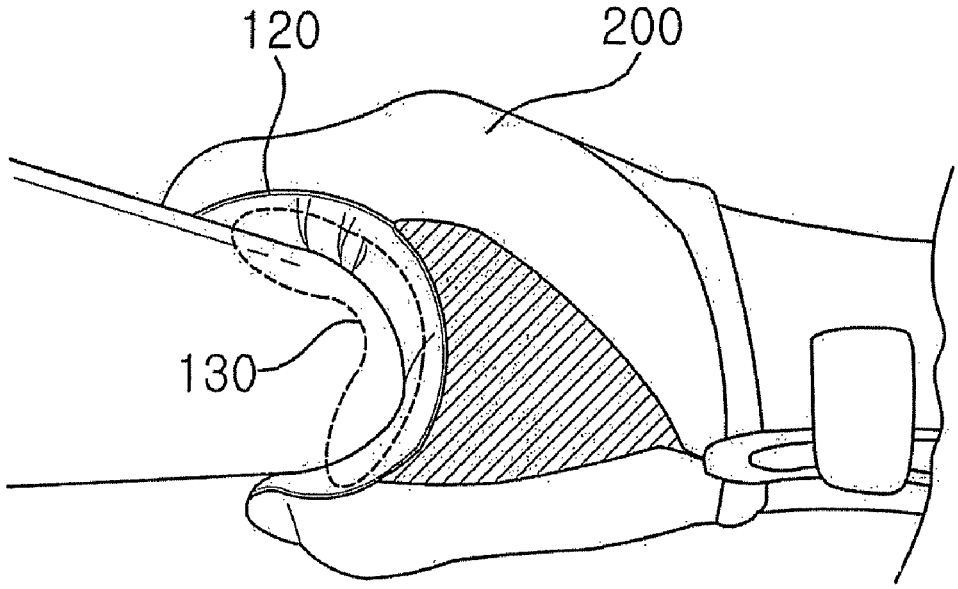

SEWN GLOVE AND METHOD OF MANUFACTURING THE SAME

BACKGROUND OF THE INVENTION

1. Field of the Invention

The present invention relates to a sewn glove and method of manufacturing the same, and more particularly, to a sewn glove, in which at least one seam is removed from a crotch between the sections for the thumb and the index finger, and a method of manufacturing the same.

2. Description of the Prior Art

In general, gloves can be roughly divided into sewn gloves and knitted gloves according to a manufacturing method thereof. The sewn gloves are manufactured by sewing the sections for the palm and the back of the hand along a cut line, whereas the knitted gloves are manufactured integrally without a separate seam.

At this time, the knitted gloves have low merchantability due to the limits to use, material, and design thereof. Generally, most of the gloves, which largely place emphasis on wearing feeling, injury protection, activity, and so on, are manufactured by a sewing method, in which various materials are cut and sewn through needlework, rather than a knitting method.

Here, the sewn gloves are manufactured by cutting a material into various pattern pieces and sewing the pieces because the thumb of the hand must have a three-dimensional structure. Hence, the sewn gloves inevitably form a plurality of seams at a crotch between the sections for the thumb and the index finger.

In the case of these sewn gloves, at least one of the seams formed at the crotch between the sections for the thumb and the index finger causes an unnatural feeling or a disconnected feeling between the hand and an object when the object is held by hands with gloves on, and thus reduces a wearing feeling, and particularly acts as a decisive factor reducing functionality thereof in particular, in the case of sport gloves which a wearer wears to get exercise in contact with a bicycle handle, a motorcycle handle, a golf club, a baseball bat, or so on which is held continuously by hands.

In spite of this problem, the reason why at least one of the seams has no alternative but to exist at the crotch between the sections for the thumb and the index finger in the sewn gloves will be described through a cut pattern of the sewn gloves that are in use currently.

As for patterns of conventional sewn gloves illustrated in FIGS. 1 and 2, all members 1 for the palm of the hand in examples 1 through 7 have a crotch cut two-dimensionally. Furthermore, the palm sheath members 1 are sewn with members for the back of the hand along a cut line of the crotch, thereby forming seams 10. Hence, at least one seam inevitably runs through the crotch.

As seen from the examples 1 through 4 of FIG. 1 and the examples 5 through 7 of FIG. 2, all of the palm sheath members 1 have a two-dimensional pattern. In this two-dimensional pattern, the seams 10 are inevitably created from the crotch of each sewn glove.

In this manner, the seam 10 formed at the crotch between the sections for the thumb and the index finger of each sewn glove suffers the biggest stress when an object is repetitively held by hand with glove on, and establishes a disconnected feeling between the object and the hand to reduce a wearing feeling as well as the resultant functionality.

Further, the conventional sewn gloves create at least one seam at the crotches between the sections for the index finger and the middle finger, between the sections for the middle finger and the ring finger, and between the ring finger and the little finger in addition to the above-mentioned crotch between the sections for the thumb and the index finger. This also causes the disconnected feeling (foreign feeling) between the hand and the object when the object is held by hands with gloves on, thereby reducing the wearing feeling.

The present applicant proposes the sewn gloves capable of enhancing the wearing feeling and the functionality of the gloves and the method of manufacturing the same, by developing a manufacturing pattern capable of removing factors reducing the wearing feeling and the functionality of the gloves, particularly, a plurality of seams formed at the crotches between the sections for the index finger and the middle finger, between the sections for the middle finger and the ring finger, and between the ring finger and the little finger as well as the crotch between the sections for the thumb and the index finger, setting the material of the palm sheath member aside, to thereby bring the crotches of the sewn gloves into close contact with the object.

SUMMARY OF THE INVENTION

Accordingly, the present invention has been made keeping in mind the above problems occurring in the prior art, and an object of the present invention is to provide a sewn glove and a method of manufacturing the same, in which, after a crotch between the sections for the thumb and each finger, particularly, the index finger is formed under predetermined pressure and temperature in a three-dimensional shape, at least one seam inevitably created at the crotch is removed using a pattern cutting a sheath member for the palm of the hand having the crotch formed in the three-dimensional shape, thereby enhancing a wearing feeling and functionality of the sewn glove.

In order to achieve the above object, according to an aspect of the present invention, there is provided a method of manufacturing a sewn glove by sewing a cut sheath member for the palm of the hand with a cut sheath member for the back of the hand. The method includes: cutting a crotch pre-form section from a palm sheath member; forming the crotch pre-form section into a three-dimensional crotch form section having a crotch form face and a cut line; and sewing the palm sheath member, which is cut from the sheath member so as to have the crotch form section, with the sheath member for the back of the hand, whereby the sewn glove has no seam at a crotch between sections for the thumb and each finger.

According to another aspect of the present invention, there is provided a method of manufacturing a sewn glove by sewing a cut sheath member for the palm of the hand with a cut sheath member for the back of the hand. The method includes: cutting a crotch pre-form section from the palm sheath member cut in an regular pattern; forming the crotch pre-form section into a three-dimensional crotch form section having a crotch form face and a cut line; and sewing the palm sheath member with the sheath member for the back of the hand, whereby the sewn glove has no seam at a crotch between sections for the thumb and each finger.

BRIEF DESCRIPTION OF THE DRAWINGS

The above and other objects, features and other advantages of the present invention will be more clearly understood from the following detailed description when taken in conjunction with the accompanying drawings, in which:

FIGS. 1 and 2 illustrate the conventional cut pattern of a sheath member for the palm of the hand and a sewn glove based on the pattern;

FIG. 3 is a view for explaining a method of manufacturing a sewn glove according to the present invention;

FIG. 4 is a perspective view illustrating a sewn glove according to the present invention; and FIG. 5 is a view illustrating usage of a sewn glove according to the present invention.

DETAILED DESCRIPTION OF THE INVENTION

Reference will now be made in greater detail to an exemplary embodiment of the invention, an example of which is illustrated in the accompanying drawings. Wherever possible, the same reference numerals will be used throughout the drawings and the description to refer to the same or like parts.

FIG. 3 is a view for explaining a method of manufacturing a sewn glove according to the present invention, FIG. 4 is a perspective view illustrating a sewn glove according to the present invention, and FIG. 5 is a view illustrating usage of a sewn glove according to the present invention.

Generally, in the sewn gloves, a sheath member for the palm of the hand makes use of leather having low elasticity and flexibility due to relatively high strength, a synthetic leather (or a synthetic suede), synthetic resin, rubber, or so on. When the palm sheath member is cut using this material, it has no alternative but to have a two-dimensional shape, which has already been described in the related art.

However, in the present invention, when the palm sheath member is cut using such a material having somewhat low elasticity and flexibility, the crotch between the sections for the thumb and the index finger is formed under predetermined pressure and temperature in a three-dimensional shape. Thereby, a cut line is adapted to be shifted from the crotch toward the back of the hand. Further, when the palm sheath member is sewn, a seam is adapted to be located at the back of the hand rather than the crotch.

As illustrated in FIG. 3, according to an embodiment of the present invention, the crotch pre-form section 105 is first cut from a sheath member 100 before the palm sheath member is cut, and then the cut crotch pre-form section is formed three-dimensionally.

In other words, in the present invention, the crotch pre-form section 105 of the planar sheath member 100 is formed into a crotch form section 110 under appropriate pressure and temperature. At this time, the crotch form section has a curved crotch form face 111 that is almost perpendicular to the sheath member.

Here, the crotch form section 110 is formed three-dimensionally with no change in shape so as to enclose the crotch between the sections for the thumb and the index finger, particularly while a top line thereof functions as a cut line 110-1 and a seam is formed along the cut line when sewn. The seam is located beyond the crotch 130 between the sections for the thumb and the index finger, as illustrated in FIG. 4.

Consequently, as illustrated in FIG. 4, the crotch 130 that is in contact with an object in the sewn glove 200 has no seam 120. In FIG. 5, it is well shown that no seam exists at the crotch contacting the held object in the sewn glove.

Meanwhile, the present invention can manufacture the sewn glove having the crotch 130 without the seam 120, by cutting the sheath member 100 of FIG. 3 into the palm sheath member having the crotch pre-form section 105, by forming the crotch pre-form section of the palm sheath member into the crotch form section 110, and by sewing the crotch form section 110.

Further, when the above-mentioned construction is applied to the crotches between the sections for the index finger and the middle finger, between the sections for the middle finger and the ring finger, and between the ring finger and the little finger in the sewn glove 200, the present invention can manufacture the sewn glove, the crotches of which have no seam.

In short, the present invention has a technical feature in that the sewn glove having the crotch 130 without the seam 120 can be manufactured by forming either the crotch pre-form section 105 of the sheath member 100 or the crotch pre-form section 105 of the palm sheath member, which is cut from the sheath member, into the crotch form section 110, by forming the crotch form section in the three-dimensional shape that has the curved crotch form face 111 that is almost perpendicular to the palm sheath member and simultaneously the cut line 110-1 located at the back of the hand, and by sewing the palm sheath member having this crotch form section with a sheath member for the back of the hand.

As is apparent from the foregoing, the sewn glove is manufactured so as to provide no seam at the crotches between the sections for the index finger and the middle finger, between the sections for the middle finger and the ring finger, and between the ring finger and the little finger, so that the wearing feeling and functionality of the sewn glove can be maximized.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method of manufacturing a sewn glove having no seam at a crotch portion thereof by sewing a first sheath member cut for a palm portion of the sewn glove with a second sheath member cut for a back portion of the sewn glove, the method comprising:

cutting a sheath member to have a crotch pre-form section;

modifying the crotch pre-form section of the sheath member into a three-dimensional crotch form section having a crotch form face and a cut line; and sewing the first sheath member, which is cut from the sheath member having the three-dimensional crotch form section to include the three-dimensional crotch form section, with the second sheath member cut for the back portion of the sewn glove.

2. A sewn glove manufactured by the method according to claim 1.

3. A method of manufacturing a sewn glove having no seam at a crotch portion thereof by sewing a first sheath member cut for a palm portion of the sewn glove with a second sheath member cut for a back portion of the sewn glove, the method comprising:

cutting the first sheath member in a regular pattern to have a crotch pre-form section;

modifying the crotch pre-form section into a three-dimensional crotch form section having a crotch form face and a cut line; and sewing the first sheath member having the three-dimensional crotch form section with the second sheath member cut for the back portion of the sewn glove.

4. A sewn glove manufactured by the method according to claim 3.

* * * * *